United States Patent [19]

Hoffeins et al.

[11] Patent Number: 4,566,268

[45] Date of Patent: Jan. 28, 1986

[54] MULTIFUEL BURNER

[75] Inventors: Hans Hoffeins, Viernheim; Richard Kalbfuss, Mannheim; Bora Ipek, Weinheim, all of Fed. Rep. of Germany

[73] Assignee: BBC Aktiengesellschaft Brown, Boveri & Cie, Baden, Switzerland

[21] Appl. No.: 608,986

[22] Filed: May 10, 1984

[30] Foreign Application Priority Data

May 10, 1983 [DE] Fed. Rep. of Germany ..... 3317035

[51] Int. Cl.[4] ..... F02C 7/22; F23D 13/36; F23R 3/36

[52] U.S. Cl. ..... 60/39.463; 60/742; 60/39.32

[58] Field of Search ..... 60/39.32, 739, 742, 60/39.463, 39.465, 733, 746, 747

[56] References Cited

U.S. PATENT DOCUMENTS

| | | | |
|---|---|---|---|
| 2,618,928 | 11/1952 | Nathan | 60/742 |
| 2,675,671 | 4/1954 | Malgieri, Jr. | 60/739 |
| 3,026,675 | 3/1962 | Vesper et al. | 60/742 |
| 3,713,588 | 1/1973 | Sharpe | 60/742 |
| 4,157,012 | 6/1979 | Du Bell | 60/39.465 |
| 4,258,544 | 3/1981 | Gebhart et al. | 60/742 |
| 4,413,470 | 11/1983 | Scheihing et al. | 60/39.32 |
| 4,499,735 | 2/1985 | Moore et al. | 60/746 |

FOREIGN PATENT DOCUMENTS

| | | | |
|---|---|---|---|
| 721126 | 12/1954 | United Kingdom | 60/746 |
| 840529 | 7/1960 | United Kingdom | 60/739 |
| 2091409 | 7/1982 | United Kingdom | 60/742 |

*Primary Examiner*—Louis J. Casaregola
*Assistant Examiner*—Timothy S. Thorpe
*Attorney, Agent, or Firm*—Herbert L. Lerner; Laurence A. Greenberg

[57] ABSTRACT

Multifuel burner having outlet locations for a plurality of fuels respectively connected with associated fuel feeding spaces arranged at a head of the burner, at least one of the fuel feeding spaces being for fuel gas and encompassing a plurality of outlet nozzles arranged annularly in a nozzle head, includes tube conduits connecting the outlet nozzles for fuel gas to the respective fuel feeding space associated therewith; the tube conduits having means for compensating for expansion of the tube conduits; the outlet nozzles having discharge openings directed outwardly at an angle of 20° to 80° to a longitudinal axis of the multifuel burner; the nozzle head having the shape of a ring cylinder; the ring-cylindrical nozzle head having an outer edge formed with a chamfer, the discharge openings of the outlet nozzles being located on the chamfer with minimal mutual spacing; and the respective outlet location for fuel gas, with respect to at least one of the number and the outlet cross section of the appertaining outlet nozzles, being of such dimension for passage therethrough of a fuel gas flow required for attaining a nominal capacity of the burner.

6 Claims, 8 Drawing Figures

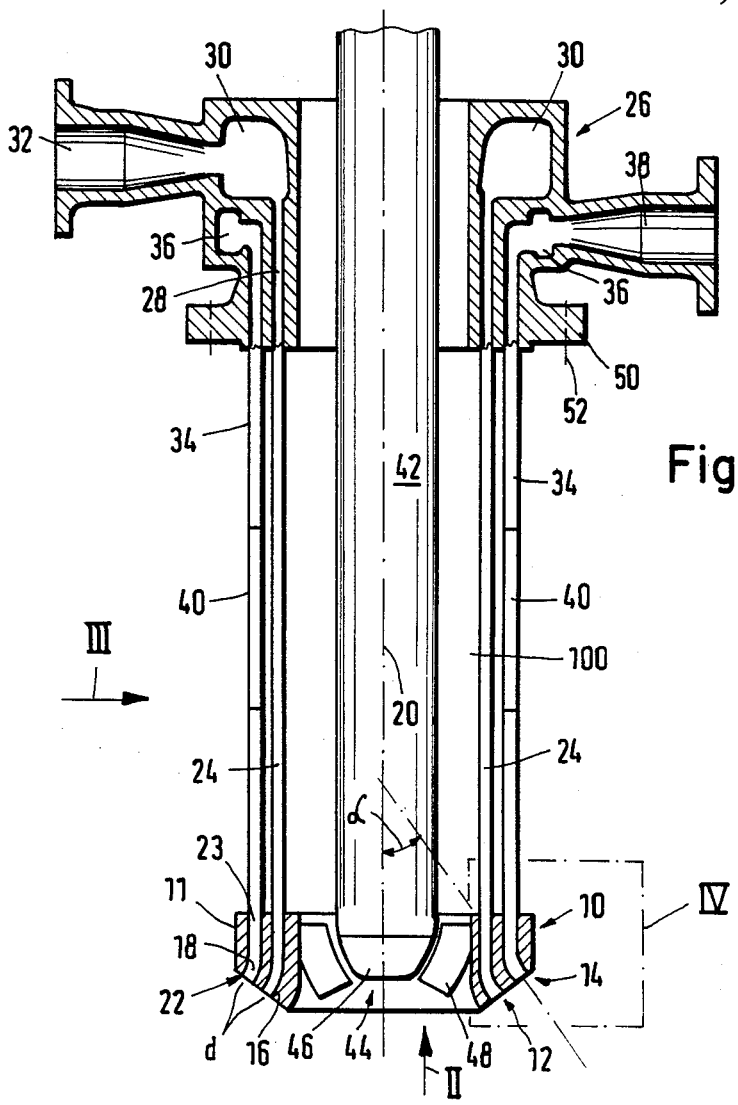
Fig.1
Fig.2
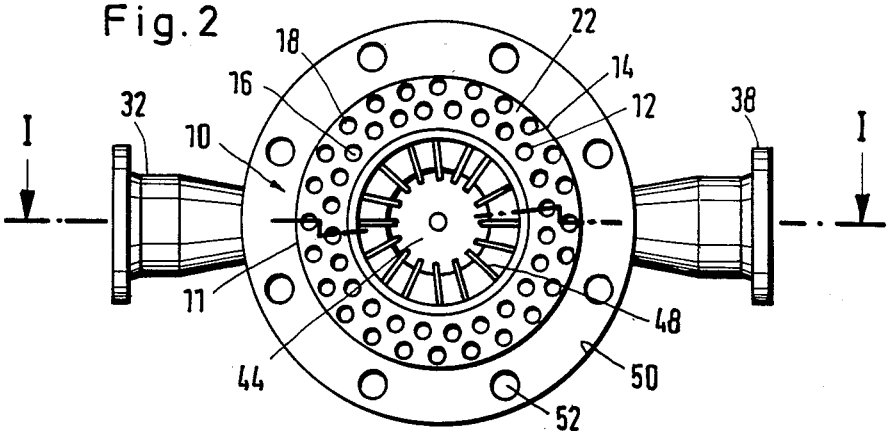

MULTIFUEL BURNER

The invention relates to a multifuel burner, and more particularly to such a multifuel burner for the combustion chamber of a gas turbine, with outlet locations for a plurality of fuels, which are respectively connected to an associated fuel feeding space arranged at the burner head, each outlet location encompassing a plurality of outlet nozzles, which are arranged annularly in a nozzle head.

A heretofore known multifuel burner of this general type includes a centric outlet location in the form of an atomizer nozzle for liquid fuels, which is surrounded by outlet locations for two different fuel gases (German Patent No. 953,551). By this means, simultaneous operation with the aforementioned fuels is possible, however, an alternative operation with one of the fuel gases, for simultaneous full burner efficiency, is not provided. Matching or adjustment of the burner to one of the types of fuel gases actually available or deliverable at a particular time, based upon a full burner capacity, is thereby not possible. In addition, the rigid configuration of the burner causes high thermally produced strains.

Furthermore, British Patent No. 985,739 shows a fuel jet for a gas turbine. This fuel jet is suitable for the combustion of fuel gas or liquid fuel; the simultaneous combustion of two fuel gases is not disclosed therein.

It is accordingly an object of the invention to provide a multifuel burner of the aforementioned general type, which is suited for simultaneous or alternative combustion, without any difficulties, of different fuel gases with nominal burner capacity and high efficiency and, in this connection, has a simple and economical or inexpensive construction. In addition, the multifuel burner is simultaneously supposed to cope fully with the thermal strains occurring during operation.

With the foregoing and other objects in view, there is provided, in accordance with the invention, a multifuel burner having outlet locations for a plurality of fuels respectively connected with associated fuel feeding spaces arranged at a head of the burner, at least one of the fuel feeding spaces being for fuel gas and encompassing a plurality of outlet nozzles arranged annularly in a nozzle head, comprising: tube conduits connecting the outlet nozzles for fuel gas to the respective fuel feeding space associated therewith; the tube conduits having means for compensating for expansion of the tube conduits; the outlet nozzles having discharge openings directed outwardly at an angle of 20° to 80° to a longitudinal axis of the multifuel burner; an annular nozzle head having the shape; the annular nozzle head having an outer edge formed with a chamfer, the discharge openings of the outlet nozzles being located on the chamfer with minimal mutual spacing; and the respective outlet location for fuel gas, with respect to at least one of the number and the outlet cross section of the appertaining outlet nozzles, being of such dimension for passage therethrough of a fuel gas flow required for attaining a nominal capacity of the burner.

By the arrangenent of several outlet locations, the number and dimensioning of which are coordinated with respect to the different fuel gas type to be fired, it is possible to burn different types of fuel gas simultaneously or alternatively, if necessary or desirable together with liquid fuels, with high efficiency and at full capacity of the burner. It is especially possible to burn a gas of inferior quality, which is by itself not combustible, together with a fuel gas of higher quality. In addition, in the case wherein a fuel gas which ignites poorly is to be burned along, a fuel gas of high ignition quality may be delivered for a brief period during the ignition operation through the other outlet location. In this connection, the subdivision of the outlet locations into a plurality of circular outlet nozzles, as well as the orientation thereof, appears highly advantageous for the desired proper mixing of the fuel gases with the supplied combustion air. Therefore, the requirement of fuel engineering which are to be met by such a multi-fuel burner, such a complete ahd soot-free combustion as well as adaptability to different fuel gases are completely fulfilled. The annular arrangement of the outlet nozzles in a common ring-cylindrical nozzle head results in a simple, economical and compact construction. By providing most minimal mutual spacing of the outlet locations for fuel gases in the radial direction, the mixture of fuel gas and combustion air exhibits, to an almost unvarying extent, good results of combustion in the case of sole operation of the one outlet location as well as in the case of sole operation of the other outlet location. This also proves to have an advantageous effect in a similar manner, if both outlet locations and, if necessary or desirable additionally the outlet location for liquid fuels are in operation. The connection of the outlet nozzles withC the associated fuel feeding spaces through tube conduits permits, on the one hand, a simply constructed gas supply for the outlet nozzles and enables, on the other hand, the arrangement of extension or expansion compensating members, in order to remove thermal stresses, which might otherwise occur in the tube conduits which are long in relation to the diameter of the multifuel burner, due to fuel gases having different temperatures. This is especially the case, if, in the one set of tube conduits, natural gas at room temperature is supplied, yet however, in the other set of tube conduits, gases from a fuel gasification plant having temperatures between 100° and 350° C. are supplied to the nozzle head. The multifuel burner according to the invention thus fulfills the essential requirements to be met by such a burner.

In order to simplify manufacture, it is recommended that all the outlet nozzles have a constant cross-section and be consequently formed of cylindrical channels, for example in the form of bores, or composed or assembled of cylindrical channel pieces of the same diameter.

In accordance with a feature of the invention, the outlet nozzles are connected advantageously individually by means of tube conduits directly with the associated fuel feeding spaces. In order to compensate for different fuel gas flows in the tube conduits and, thus, to guarantee a steady fuel gas supply to the outlet nozzles, it is expedient that the outlet nozzles of the individual outlet locations be connected, respectively, through the intermediary of a collector, preferably arranged in the nozzle head via the tube conduits to the associated fuel feeding spaces.

As an extension or expansion compensating device for the tube conduits, various conventional systems are possible, however, the lowest expenditure in connection with absolute tightness of the extension or expansion compensating devices against leakage is advantageously provided when, in accordance with the invention, there is at least one change of direction in the linear extension of the tube conduit.

Other features which are considered as characteristic for the invention are set forth in the appended claims.

Although the invention is illustrated and described herein as embodied in multifuel burner, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which:

FIG. 1 is diagrammatic vertical longitudinal section of a multifuel burner according to the invention taken along the line I—I in FIG. 2;

FIG. 2 is a bottom view of FIG. 1 as seen in the direction of the arrow II;

In the individual figures, like parts are identified by the same reference numerals.

Figure 3:
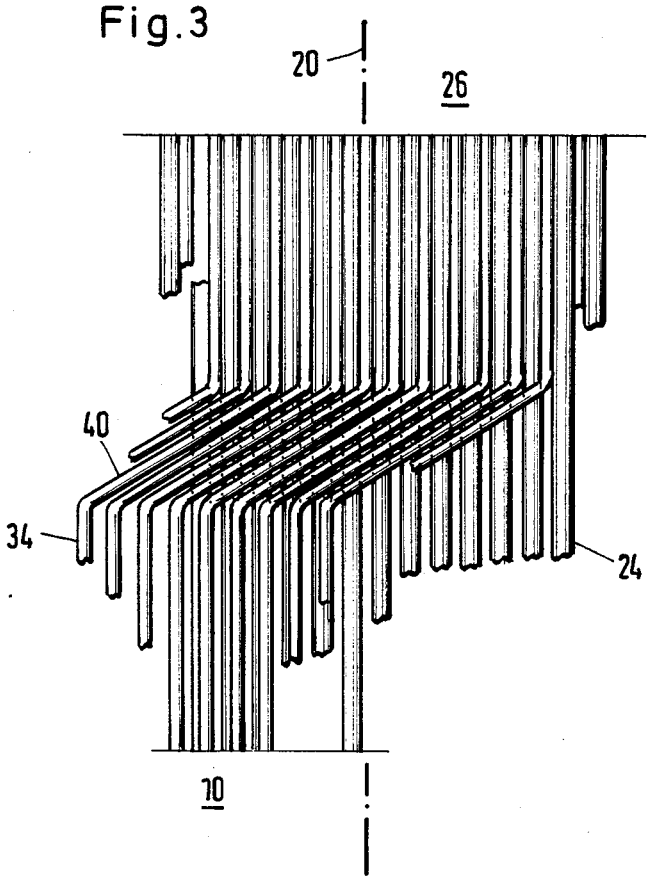
FIG. 3 is a developed view, in the plane of the drawing, of a plurality of tube conduits which connect outline nozzles with fuel feeding spaces, as viewed in the direction of the arrow III in FIG. 1.

Referring now to the drawing and first, particularly, to FIG. 1 thereof, there is shown a multifuel burner which includes a nozzle head 10 in the form of a ring-cylinder 11, wherein a first outlet location 12 and a second outlet location 14, for one combustible fuel gas each, are arranged. Both outlet locations 12 and 14 are each formed of a plurality of outlet nozzles 16 and 18, respectively. As is evident mainly from FIG. 2, the outlet nozzles of each outlet location 12, 14 are arranged in the form of a circular ring and uniformly distributed in the nozzle head 10, the outlet nozzles 16 of the first outlet location 12 being concentrically surrounded by the outlet nozzles 18 of the second outlet location 14 and, as seen in radial direction, being staggered with respect to the outlet nozzles 18. In this connection, it is very important for a compact construction that the radial distance d between the respective outlet nozzles 16 and 18 be as small as possible.

The discharge openings of the outlet nozzles 16 and 18 are directed outwardly at an angle $\alpha$ of 20° to 80° with respect to the longitudinal axis 20 of the multifuel burner. In this regard, the forward outer edge of the ring-cylindrical nozzle heat 10 is provided with a chamfer 22 or a circular face inclined with respect to the longitudinal axis 20, the circular face being oriented in such a manner that the axes of the discharge openings pass through this chamfer 22 vertically. A respective region 23 provided in the nozzle head and extending parallel to the longitudinal axis 20 of the multifuel burner is connected in the nozzle heat to the discharge-opening region of the outlet nozzles 16 and 18 which is inclined with respect to the longitudinal axis 20. The axial length of the discharge-opening region is short when compared with the total length of the nozzle head 10 (ratio 1:4 to 1:6), as is clearly evident from FIG. 1. The outlet nozzles 16 and 18 are machined into the nozzle head 10 as cylindrical bores.

A rectilinear tube conduit 24 is connected at one end thereof to each of the circularly arranged outlet nozzles 16 of the first outlet location 12, at the upper end of the nozzle head each of the tube conduits 24 extending in parallel with the longitudinal axis 20 of the multifuel burner and terminating at the other end thereof in a substantially ring-cylindrical burner head 26 coaxial to the nozzle head. For this purpose, cylindrical bores 28, extending in the direction of the longitudinal axis 20, are provided in the burner head 26, the bores 28 terminating in an annular-shaped and concentric first fuel feeding space 30 arranged at the upper end of the burner head. This space 30 is provided with a first connecting sleeve 32 located at the left-hand side in the sectional plane of FIG. 1 and extending in radial direction. The connecting sleeve 32 may also extend perpendicularly to the plane of the drawing i.e. may extend towards the viewer. Several connecting sleeves may possibly be provided.

In the same manner, the outlet nozzles 18 of the second outlet location 14 are also connected by additional tube conduits 34 to a coaxial second fuel feeding space 36. This space 36 is likewise of annular construction and is machined into the burner head 26 below the first fuel feeding space 30. A radially extending second connecting sleeve 38 directed towards the right-hand side in the sectional plane of the drawing of FIG. 1, is connected to the second fuel feeding space 36. The additional tube conduits 34 surround the tube conduits 24.

The additional tube conduits 34, which are connected to the second outlet location 14, are respectively provided with an extension or expansion compensating member 40. In FIG. 3, which shows a development of some of the annularly arranged tubes 24 and 34 in the plane of the drawing, the configuration of these extension or expansion compensating members 40 is clearly evident. Thereafter, the additional tubes 34 are provided with two changes of direction in such a manner that these tubes 34, starting from the nozzle head 10, extend initially rectilinearly and parallel to the longitudinal axis 20, then form a bend or knee and are oriented at an angle $\beta$ of 30° to 60° with respect to the longitudinal axis 20 and to the specific longitudinal axis of the tube 34, respectively, and are brought by a further bend finally again into the direction of the longitudinal axis 20. Preferably, the bend is carried out at an angle as large as possible to the respective longitudinal axis of the tube conduit, in order to increase the efficiency of the extension or expansion compensating member thus formed. On the other hand, care must be taken that all tube conduits be bent at the same angle and that intersections of these tube conduits do not occur in the assembly-like arrangement on a cylindrical face, but rather that they extend side by side. This is very clearly evident from FIG. 3, to which reference is explicitly made. Preferably, the extension or expansion compensating members are arranged approximately in the middle of the spacing between the burner head 26 and nozzle head 10. Further details may be taken from FIGS. 6 and 7 as well as from the appertaining description.

As is further evident from FIGS. 1 and 2, a coaxially arranged cylindrical nozzle stock 42, extending into the interior space of the nozzle head 10, is provided in the center of the multifuel burner, the lower end of the nozzle stock 42 forming an outlet location 44 in the form of an atomizer nozzle 46 for liquid fuels, for example fuel oil. The upper end of the nozzle stock 42 may terminate in a feeding chamber for liquid fuels which is not shown in the drawing. In the annular gap which is provided between the nozzle head 10, on the one hand, and the nozzle stock 42 or the atomizer nozzle 46, on the other hand, a plurality of radially extending air guide or turbulence plates 48 are provided in the region of the atomizer nozzle 46. The air guide plates 48 have the shape of circular ring segments.

Figure 8:
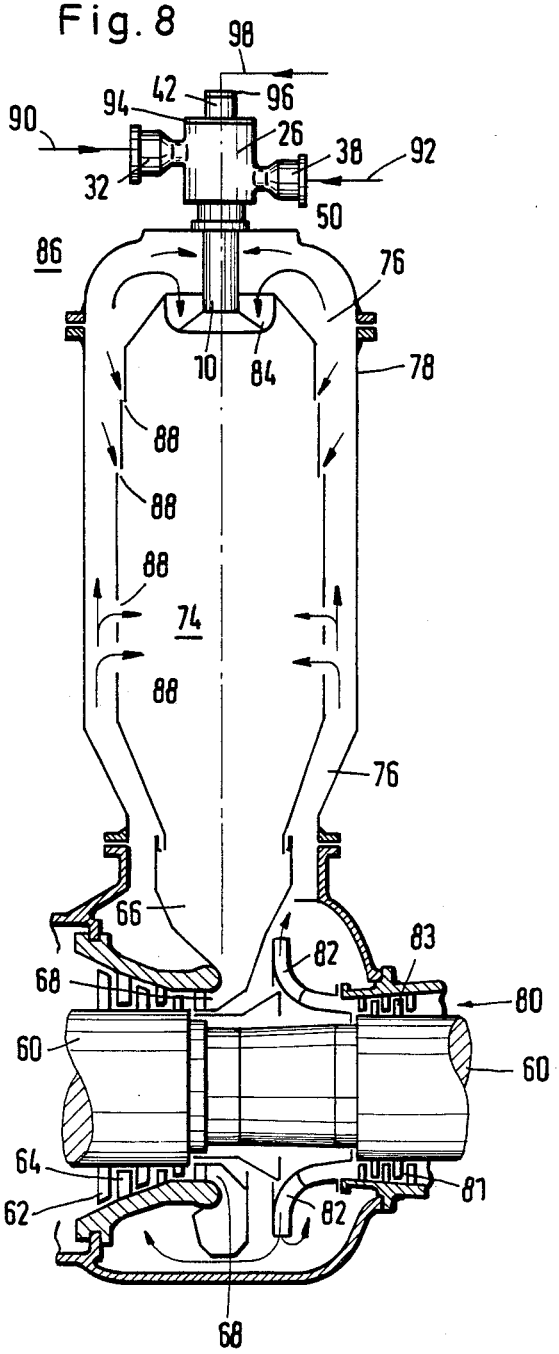
FIG. 8 is a diagrammatic vertical sectional view of the region of the combustion chamber of a gas turbine connected with the multifuel burner according to FIG. 1.

Moreover, at the lower end of the burner head 26, an outer flange 50 having mounting or fastening bores 52 is arranged for securing the multifuel burner, for example, to the combustion chamber. The supply and/or guidance devices for the combustion air belonging to a multifuel burner or forming a part of the multifuel burner are shown in FIG. 8.

During operation, fuel gases are fed through the connecting sleeves 32 and 38 as well as the tube conduits 24 and 34 to the outlet nozzles 16 an 18 for combustion. Simultaneously, liquid fuel may be added through the nozzle stock 42 and may be burned by means of the atomizer nozzle 46. By appropriate dimensioning or design of the atomizer nozzle 46 and the outlet nozzles 16 and 18 and the appertaining fuel gas feeding devices, such as the tube conduits 24 and 34 as well as the feeding spaces 30 and 36, it is possible to attain the full nominal capacity of the burner by the operation of one of the outlet spots 12, 14, 44, respectively; of course, other combinations are conceivable and possible. If, in this connection, the burning of liquid fuels is to be dispensed with completely, then the nozzle stock 42 may be removed and replaced by a dummy of the same shape so that the flow relations at the nozzle hand remain unchanged. The sum of the free flow cross-sections of the tube conduits 24 and of the appertaining outlet nozzles 16, respectively, is, preferably equal to 0.8 to 1-fold that of the free cross-section of the appertaining connecting sleeve 32. This is also true for the tube conduits 34, the outlet nozzles 18, and the appertaining connecting sleeve 38.

Due to the fact that the gaseous fuels, which are supplied to the outlet locations 12 and 14, have mostly different temperatures, at the conventionally prescribed spacings between the burner head and the nozzle head of approximately 0.5 to 1.5 m, expansion differences of the tubes 24 and 34 of approximately 0.5 to 1.5 mm result, which are taken up and compensated for by the extension or expansion compensating members 40. Expansion differences also occur if the combustion air blowing in the intermediate space 76 is preheated (not FIG. 8).

Figure 4:
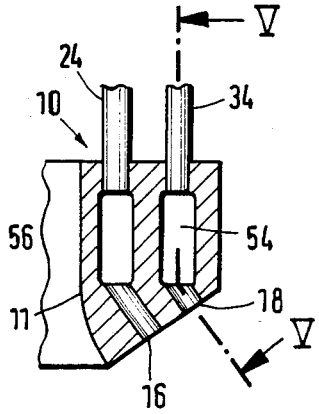
FIG. 4 is an enlarged fragmentary view of FIG. 1 showing a modified embodiment of the detail in the box IV drawn with phantom lines.

FIG. 4 is an enlarged view of a modified embodiment of the parts shown in the detail IV of FIG. 1. Whereas, in the embodiment according to FIGS. 1 to 3, each of the outlet nozzles 16 and 18 is directly connected to the associated fuel feeding space 30, 36, respectively, via a tube conduit 24, 34, in the embodiment according to FIGS. 4 and 5, collectors or manifolds 54 and 56 are positioned between the outlet nozzles 18 and 16, respectively, and the tube conduits 34 and 24. The respective outlet nozzles 16 and 18 of each individual outlet location 12, 14 terminate in a collector 56 and 54, respectively. The respective tube conduits 34 and 24, which lead to the fuel feeding spaces, are connected to the collectors 54 and 56, respectively. The number of these tube conduits 24 and 34 may be smaller than the number of the outlet nozzles 16 and 18, if the tube conduits yet remaining then are advantageously connected with uniform distribution to the collectors 54 and 56 and have a cross section adequate for the fuel gas transport, and if they are dimensioned or designed for an adequate fuel gas transport, respectively.

Figure 5:
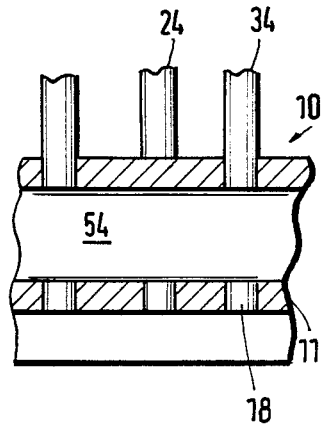
FIG. 5 is a sectional view of FIG. 4 taken along the line V—V and presented as a developed view in the plane of the drawing.

As is evident from FIGS. 4 and 5, the collectors 54 and 56 are formed in the nozzle head 10 as annularly-shaped cavities with a rectangularly-shaped cross section. This can be readily achieved in the case of nozzle heads which are produced with the aid of a casting method.

In the aforedescribed manner, of course, it is also possible to provide more than two outlet locations for gaseous fuels, it being possibly necessary then to provide extension or expansion compensating members in the appertaining tube conduits.

For the dimensioning or design of the multifuel burner of the invention, the following standard values apply. The diameter of the nozzle head and the thickness thereof in radial direction are so chosen that the number of outlet nozzles which are required in order to attain the design nominal capacity of the burner can be incorporated therein. In this connection, possibly the provision of a central outlet location for liquid fuels and/or the centric supply of combustion air and the arrangement of guide plates are also to be taken into consideration. The nozzle head is to be dimensioned in axial direction just with respect to the configuration of the outlet nozzles and, if necessary or desirable with respect to the arrangement of the collectors.

Figure 6:
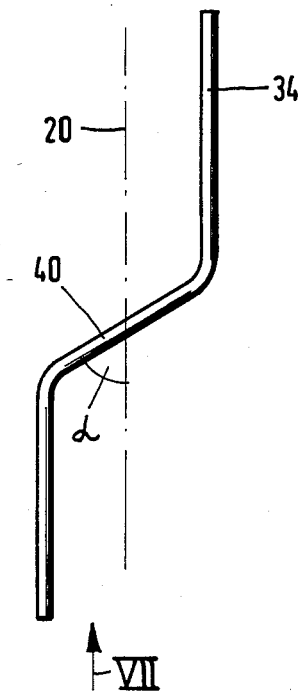
FIG. 6 is a fragmentary view of FIG. 3 showing one of the tube conduits provided with an extension or expansion compensating mumber.

In FIG. 6, another tube conduit 34 is shown as a detail in a longitudinal view. The extension or expansion compensating member 40 is evident in the form of a bend in the additional tube conduit 34. The direction of the bend at an angle $\beta$ of 20° to 80°, and preferably 30° to 70°, to the longitudinal axis 20 is clearly evident. The bend resiliently absorbs changes of length in the tube conduit, it being necessary to observe that the bend have a length transverse to the longitudinal axis 20 which is sufficient to enable the bend to react elastically.

Figure 7:
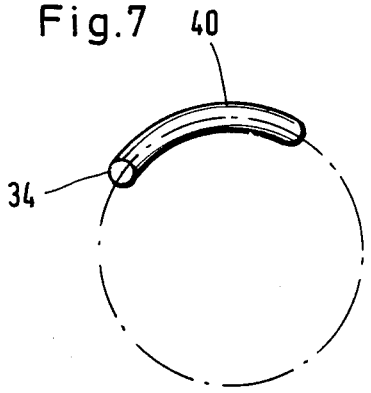
FIG. 7 is an enlarged view of FIG. 6 as seen in direction of the arrow VII, whilst

FIG. 7 presents an enlarged view of the additional tube conduit 34 in a condition ready for installation as seen in the direction of the arrow VII of FIG. 6. It is evident that each additional tube conduit 34, particularly in the region of the bend (extension or expansion compensating member 40), has the form of a circular arc. This is necessary in order to be able to connect the annularly arranged outlet nozzles 14 to the bores, which are likewise annularly arranged in the burner head 26.

FIG. 8 is a vertical sectional view of a gas turbine installation in combination with a multifuel burner of the invention of the instant application. On the turbine shaft 60, several rows of rotatable blades 62 are mounted, which revolve between associated rows of guide blades or vanes 64. In front of the first row of the guide blades or vanes, an overflow housing 66 terminates and forms a propellant gas inlet 68. This inlet 68 is provided in annular form so that the rows of guide vanes 64 and rotating blades 62 are able to be subjected to the applied force of the propellant gases over the entire circumference thereof. For this purpose, the overflow housing 66, in that region which is adjacent to the rotating blades 62, is constructed somewhat in the form of a torus having an annular opening, which forms the propellant gas inlet 68.

A radially extending cylindrical combustion chamber 74 is added to the torus-like region of the overflow housing 66. The combustion chamber 74 is bell-like and is connected at the lower end thereof to the overflow housing 66. In the upper closed end region of the combustion chamber 74, the multifuel burner is centrically located. The combustion chamber 74 as well as the overflow housing 66 are surrounded by a shell 78 with an intermediate space 76 defined therebetween. The air for combustion is supplied into this intermediate space 76. In the illustrated embodiment of FIG. 8, the combustion air is compressed in an axial compressor 80 with guide blades 81 and rotating blades 83 integrated into the gas turbine installation, the compressor 80 having a common shaft 60 with the turbine, the combustion air being supplied via a diffuser 82 to the intermediate space 76.

The nozzle head 10 of the multifuel burner projects into the combustion chamber 74 and is surrounded by radially extending and uniformly distributed guide blades or vanes 84 formed of sheet or plate metal for the combustion air. The guide vanes 84 are each of propeller-like shape and are arranged with such mutual spacing that combustion air is able to enter between the guide vanes 84 from the intermediate space 76 into the combustion chamber 74. The contour of the guide vanes 84 is clearly evident from FIG. 8. The number of guide vanes 84 is between 8 and 16 vanes. Additional combustion air may enter through radial openings 88 formed in the wall of the combustion chamber 74. The flow of the combustion air is indicated by arrows.

The multifuel burner extends through the intermediate space 76 in vertical direction up to an outer space 86, and the flange 50 of the burner head 26 is mounted on the outside of the upper horizontal region of the shell 78. The first connecting sleeve 32 is provided with a pipeline 90 through which a fuel gas e.g. a fuel gas having a low heating value, may be supplied. A pipeline 92 through which another fuel gas e.g. a fuel gas having a higher heating value, may be supplied, is connected to the second connecting sleeve 38. The upper end of the burner head 26 is closed by a cover 94, through which the nozzle stock 42 extends. The upper end of the nozzle stock 42 is also closed by a cover 96 and is provided with a pipeline 98, through which a liquid fuel e.g. fuel oil, may be supplied. The upper end of the nozzle stock 42 forms the fuel feeding space for liquid fuel.

During operation, air is led into the intermediate space 76 through the diffuser 82, the air then entering the combustion chamber 74 through the lateral openings 88. Simultaneously, air flows between the guide blades or vanes 84 into the combustion chamber 74 and is mixed with the fuels coming from the nozzle head 10. Due to the fact that the discharge openings of the outlet nozzles 16 and 18 are directed outwardly, an excellent mixture of the fuel gases with the air entering the combustion chamber 74 between the guide blades 84 is produced (in this connection, note also FIG. 1).

Additional combustion air flows through an annular space 100 located between the nozzle stock 42 and the tube conduits 24, into the combustion chamber 74, which has a circular cross-section (note FIG. 1.) The combustion air thereby flows from the intermediate space 76, through the gaps which are formed between the tube conduits 24 and 34 and into the annular space 100, and from there through the vortex or turbulence plates 48 into the combustion chamber 74. This air primarily serves for the combustion of the liquid fuel which, under pressure, enters the combustion chamber through the atomizer nozzle 46. The vortex or turbulence plates 48 extend in radial direction and are arranged in a greater number e.g. eight to twelve plates, uniformly around the atomizer nozzle 48. The shape of the vortex plates 48 is clearly shown in FIG. 1.

During operation, the fuels are consumed individually or in any possible combination by the multifuel burner in the combustion chamber 74; the hot propellant gases resulting thereby then flowing to the propellant or driving gas inlet 68. From there, the propellant gases flow toward the left-hand side of FIG. 8 to the guide and rotating blades 64 of the gas turbine, so that the turbine shaft 60 is driven.

The nominal capacity of the burner can be attained even by the operation of only a single outlet location 12, 14, 44.

By nominal capacity of the burner, there is meant that capacity of the burner for which the burner is designed and built.

The foregoing is a description corresponding, in substance, to German application No. P 33 17 035.5, dated May 10, 1983, International priority of which is being claimed for the instant application, and which is hereby made part of this application. Any material discrepancies between the foregoing specification and the specification of the aforementioned corresponding German application are to be resolved in favor of the latter.

There are claimed:

1. Multifuel burner having outlet locations for a plurality of fuels respectively connected with associated fuel feeding spaces arranged at a head of the burner, at least two of the fuel feeding spaces being for fuel gas and encompassing a plurality of outlet nozzles arranged annularly in a nozzle head, comprising:

(a) a plurality of first tube conduits connecting respective ones of the outlet nozzles for fuel gas to one of the respective fuel feeding spaces associated therewith, and a plurality of second tube conduits connecting respective others of the outlet nozzles to the other of the respective fuel feeding spaces;

(b) the nozzle head having an annular shape and an outer edge formed with a chamfer inclined with respect to said longitudinal axis, the outlet nozzles having discharge openings extending perpendicularly through said chamfer and being inclined outwardly at an angle of 20° to 80° to said longitudinal axis;

(c) said first tube conduits extending rectilinearly and parallel to the longitudinal axis of the burner and being annularly disposed around said longitudinal axis;

(d) said second tube conduits being each formed with at least two changes in direction of the linear extension thereof in a manner that, starting from the nozzle head, said second tube conduits each extend initially rectilinearly and parallel to said longitudinal axis of the burner, then have a bend therein at an angle of 20° to 80° with respect to said longitudinal axis, and then have a bend therein bringing them again into the direction of said longitudinal axis;

(e) the outlet nozzles as well as the respective first and second tube conduits as well as the one and the other fuel feeding spaces, respectively, being of such dimensions with respect to the cross sections and the numbers thereof that a nominal full capacity of the burner is attainable during operation with said ones and said others of the outlet nozzles, respectively.

2. Multifuel burner according to claim 1 wherein the outlet nozzles are formed of cylindrical channels.

3. Multifuel burner according to claim 1 wherein the outlet nozzles of the respective outlet location are connected individually and directly via said tube conduits to said at least one fuel feeding space associated therewith.

4. Multifuel burner according to claim 1 wherein the outlet nozzles of the respective outlet location are connected, with the intermediary of a respectivc manifold, via said tube conduits to said at least one fuel feeding space associated therewith.

5. Multifuel burner according to claim 1 wherein the fuel feeding spaces are disposed one behind the other in direction of said longitudinal axis of the multifuel burner.

6. Multifuel burner according to claim 1 in combination with a combustion chamber of a gas turbine, wherein the burner head of the multifuel burner extends into said combustion chamber.

* * * * *